US005354217A

United States Patent [19]

Gabel et al.

[11] Patent Number: 5,354,217

[45] Date of Patent: Oct. 11, 1994

[54] LIGHTWEIGHT CONNECTOR FOR A COAXIAL CABLE

[75] Inventors: Lee R. Gabel, Orland Hills; Sitaram Rampalli, Orland Park; James A. Wu, Lockport, all of Ill.

[73] Assignee: Andrew Corporation, Orland Park, Ill.

[21] Appl. No.: 71,762

[22] Filed: Jun. 10, 1993

[51] Int. Cl.[5] ..... H01R 17/04

[52] U.S. Cl. ..... 439/583; 439/584

[58] Field of Search ..... 439/578–585, 439/675

[56] References Cited

U.S. PATENT DOCUMENTS

| | | | |
|---|---|---|---|
| 3,199,061 | 8/1965 | Johnston et al. . | |
| 3,291,895 | 12/1966 | Van Dyke . | |
| 4,046,451 | 9/1977 | Juds et al. . | |
| 5,127,843 | 7/1992 | Henry et al. | 439/583 |
| 5,137,470 | 8/1992 | Doles . | |
| 5,154,636 | 10/1992 | Vaccaro et al. . | |
| 5,167,533 | 12/1992 | Rauwolf . | |

*Primary Examiner*—David L. Pirlot
*Attorney, Agent, or Firm*—Arnold, White & Durkee

[57] ABSTRACT

A connector assembly for a coaxial cable having an outer conductor and an inner conductor includes a center conductor. A flaring ring and a clamping member are disposed adjacent to each other, and the outer conductor of the coaxial cable is engaged between the back end of the ring and the end of the clamping member. A body member holds the flaring ring and the clamping member together with the outer conductor of the cable located therebetween. A coupling nut, secured to the body member and disposed around the center conductor, is used to engage the connector with a mating connector. A conductive insert positioned within the body member provides electrical contact between the flaring ring and a mating connector. The connector assembly further includes a dielectric insulator, disposed between the center conductor and the conductive insert, for centering the center conductor with respect to the conductive insert and for electrically isolating the center conductor from the conductive insert. The clamping member, the body member, and the coupling nut are fabricated from polymeric materials, and the conductive insert is fabricated from an electrically conductive material.

7 Claims, 2 Drawing Sheets

LIGHTWEIGHT CONNECTOR FOR A COAXIAL CABLE

FIELD OF THE INVENTION

The present invention relates generally to connectors for coaxial cables, and, more particularly, to a lightweight connector that is particularly suitable for aircraft installations or other applications where the cumulative weight of numerous coaxial connectors is an important consideration.

BACKGROUND OF THE INVENTION

Heretofore, connectors for coaxial cables have been fabricated from conductive metals such as brass. The metallic composition of such connectors tends to make the connectors relatively heavy. In applications such as aircraft, satellites, ships or other vehicles, where weight is of paramount importance, the heavy weight load caused by using a substantial number of connectors can be problematic. Moreover, it is relatively expensive to fabricate connectors from entirely metallic materials, especially in large quantities. Accordingly, there exists a need for a coaxial cable connector which overcomes the above-noted drawbacks associated with existing connectors.

SUMMARY OF THE INVENTION

It is a primary object of the present invention to provide an improved coaxial cable connector which weighs considerably less than previous connectors, while still providing good electrical performance.

It is another object of the invention to provide such an improved connector which can be efficiently and economically manufactured at a lower cost than previous connectors.

Other objects and advantages of the invention will be apparent from the following detailed description and the accompanying drawings.

In accordance with the present invention, the foregoing objectives are realized by providing a connector assembly for a coaxial cable having an outer conductor and an inner conductor; an electrically conductive flaring ring and a polymeric clamping member for engaging the outer conductor of the coaxial cable; a polymeric body member having means for holding the flaring ring and the clamping member together, against the outer conductor of the cable; and an electrically conductive insert secured within the body member, in electrical contact with the flaring ring.

DETAILED DESCRIPTION OF THE PREFERRED EMBODIMENT

Figure 1:
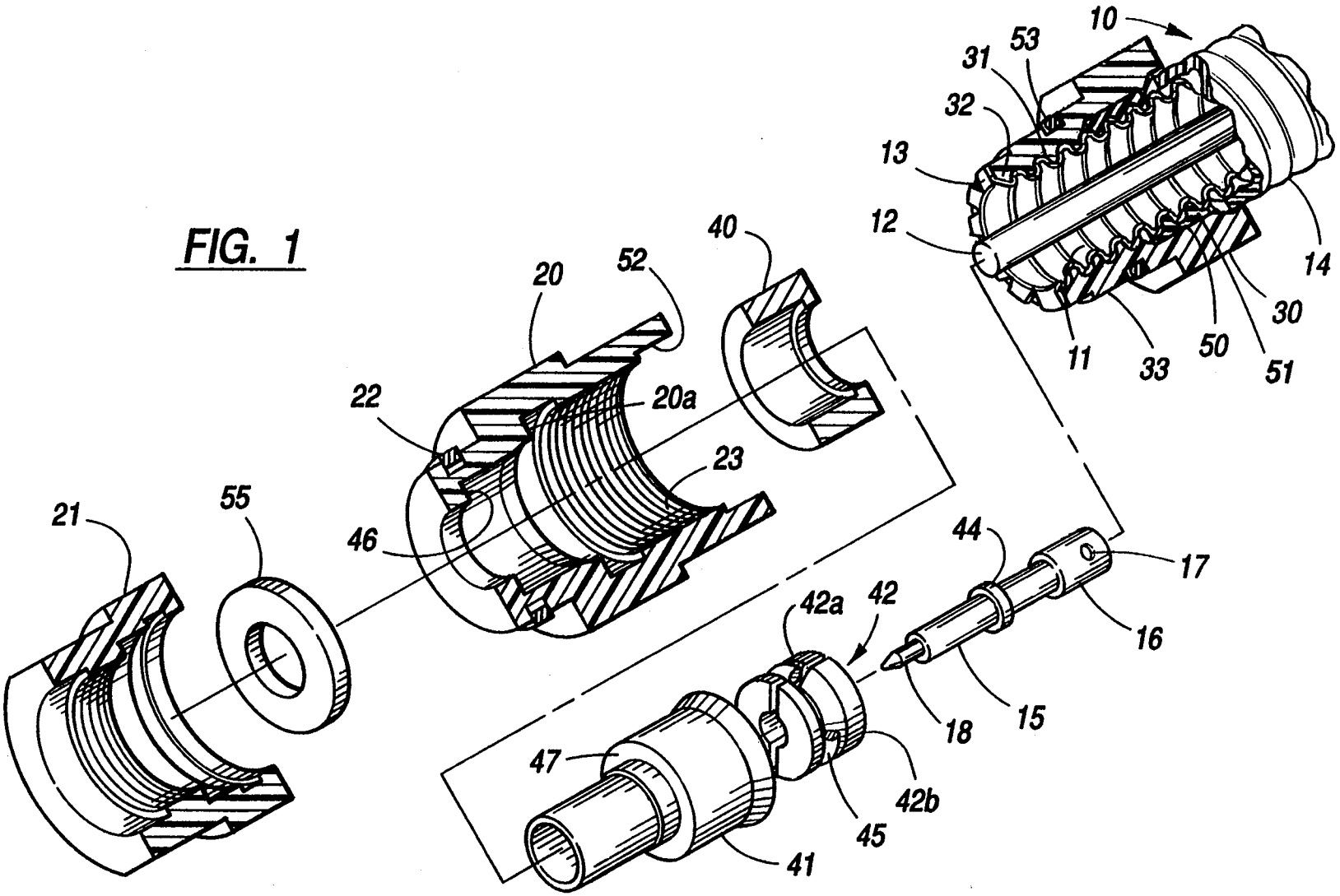
FIG. 1 is an exploded perspective view of a connector embodying the present invention.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

Figure 2:
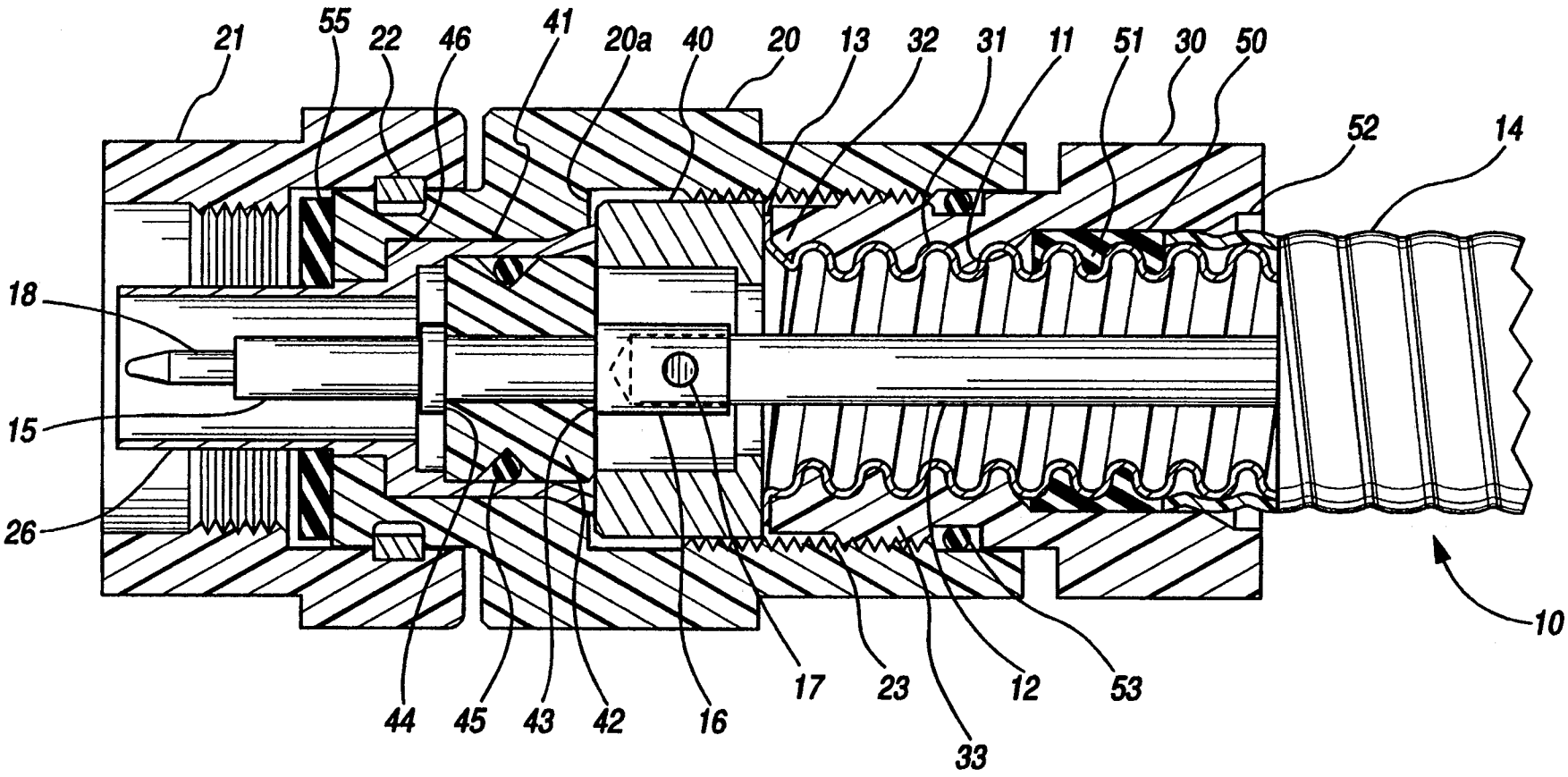
FIG. 2 is an enlarged longitudinal sectional view of the connector of FIG. 1, fully assembled on the end of a coaxial cable.

Turning now to FIGS. 1 and 2, there is shown a connector assembly for a coaxial cable 10 having a helically corrugated outer conductor 11 concentrically spaced from an inner conductor 12 by a dielectric spacer (not shown).

To prepare the cable 10 for attachment of the connector assembly, the end of the cable is cut along a plane extending perpendicular to the axis of the cable and through the apex of one of the crests of the corrugated outer conductor 11. This exposes the clean internal surface of the outer conductor 11. The outer conductor is then cut radially at intervals around the circumference and flared outwardly as at 13 by use of a pliers or other suitable tool. Any burrs or rough edges on the cut ends of the metal conductors 11 and 12 are preferably removed to avoid interference with the connector. The outer surface of the outer conductor 11 is normally covered with a plastic jacket 14 which is trimmed away from the end of the outer conductor 11 along a sufficient length to accommodate the connector assembly.

Electrical contact with the inner conductor 12 of the cable 10 is effected by a conventional center conductor 15, which is attached at its hollow base 16 to the front end of the inner conductor 12. In the preferred embodiment, the center conductor 15 is secured to the inner conductor 12 by placing solder within the hollow base 16 and telescoping the base 16 over the end of the inner conductor 12. An aperture 17 in the base 16 provides an escape for overflow solder. The head 18 of the center conductor 15 forms the male portion of a conventional connector.

A stepped cylindrical body member 20 extends around the cut end of the coaxial cable 10. The reduced-diameter end portion of the body member 20 carries a coupling nut 21. This coupling nut 21 is secured to the body member 20 by a spring retaining ring 22 which holds the nut 21 captive on the body member 20 while permitting free rotation of the nut 21 on the member 20.

A clamping member 30 has a corrugated inner surface 31 to match the helical corrugations of the outer conductor 11. Thus, the member 30 can be threaded onto the outer conductor 11 until the end 32 of the clamping member 30 engages the flared end 13 of the outer conductor 11.

To make electrical connection with the inner surface of the outer conductor 11 of the coaxial cable 10, a brass flaring ring 40 is secured within the body member 20. The forward side of the flaring ring 40 abuts with the rear side of the conducting insert 41, and the rear side of the flaring ring 40 opposes the front end 32 of the clamping member 30. The inside diameter of the rear side of the ring 40 is preferably about the same as the minor inside diameter of the outer conductor 11 to ensure contact with the maximum area of the flared end portion 13 of the outer conductor 11. The outwardly flared end portion 13 of the outer conductor 11 is clamped between the flaring ring 40 and the clamping member 30. The flaring ring 40 engages the inner surface of the flared end portion 13, and the clamping member 30 engages the outer surface.

For the purpose of drawing the flaring ring 40 and the clamping member 30 firmly against opposite sides of the flared end portion 13 of the outer conductor 11, the body member 20 and the clamping member 30 include respective telescoping sleeve portions 23 and 33 with cooperating threaded surfaces. Thus, when the body member 20 is threaded onto the clamping member 30, the two members are advanced toward each other in the axial direction so as to draw the flaring ring 40 into electrically conductive engagement with the flared end portion 13. When the flared end portion 13 of the outer conductor 11 is clamped between the flaring ring 40 and the clamping member 30, it is also flattened to conform with the planar clamping surfaces. To disengage the connector assembly, the body member 20 is simply threaded off the clamping member 30 to retract the two members away from each other until their threaded surfaces are disengaged.

To provide a moisture barrier between the inner surface of the clamping member 30 and the outer surface of the outer conductor 11, a gasket 50 is positioned within the cylindrical portion of the clamping member behind the corrugated surface that mates with the corrugations of the outer conductor. The gasket 50 has a corrugated inner surface 51 to match the helical corrugations of the outer conductor 11. When the clamping member 30 is threaded onto the outer conductor 11, the gasket 50 compresses slightly so that the gasket bears firmly against both the outer surface of the conductor 11 and the inner surface of the clamping member 30. The end portion 52 of the clamping member 30 has a slightly larger inside diameter than the threaded portion so that it can fit over the end of the polymeric jacket 14 on the coaxial cable 10. A moisture barrier is also provided by an O-ring 53 positioned between the opposed surfaces of the sleeve portions 23 and 33 of the members 20 and 30, respectively.

In existing coaxial connectors, electrical contact with the outer conductor of a cable is achieved by an electrical conducting path formed in part by a flaring ring and a body member. In order to provide this conducting path, the connector components forming the path are all made of a metal having good electrical conductivity.

The connector of the present invention provides electrical contact with the outer conductor 11 of the cable 10 at a fraction of the weight of existing connectors, by providing a different conducting path than existing connectors. Instead of using the flaring ring 40 and the body member 20 to form the conductive path, the connector employs an electrically conductive insert 41 arranged within the body member 20. This insert 41 extends slightly beyond the shoulder 20*a* to ensure electrical contact with the flaring ring 40, and extends forwardly therefrom through the interior of the body member 20 and the major portion of the length of the coupling nut 21. A gasket 55 is captured between the coupling nut 21 and the insert 41 to provide an insulated sealing surface for a mating connector.

To support the inner conductor 15 concentrically within the conductive insert 41, a dielectric sleeve 42 is carried on the inner conductor 15 between the shoulder 44 and the front end of the base 16 of the center conductor 15. In the illustrative embodiment, the sleeve 42 is formed in two parts 42*a* and 42*b* which are held together on the inner conductor 15 by an O ring 45.

To hold the conductive insert 41 against the flaring ring 40, the body member 20 forms a shoulder 46 which bears against a complementary shoulder 47 on the insert 41. Then as the body member 20 is threaded onto the clamping member 30, the shoulder 46 presses the insert 41 firmly against the flaring ring 40 to maintain good electrical contact between the insert 41 and the ring 40.

The body member 20, the coupling nut 21 and the clamping member 30 are all made of lightweight material such as a polymer either singly or in combination containing more than one polymer such as a polymer blend and/or alloy, or a polymer composite, such as glass and/or metal reinforced structure, or a filled polymeric composition. The polymeric compositions described above can be either a thermoplastic, thermoset, elastomeric, thermoplastic elastomer, or a liquid molding resin. These materials are normally non-conductive, and can be made to provide the requisite strength with only a fraction of the weight of similar parts made of metal. The term "polymeric material" as used herein, and in the appended claims, includes all the above materials.

The weight of the connector can be further reduced by reducing the size of the flaring ring, or even eliminating it and contacting the outer conductor 11 directly with the insert 41.

To maintain an impedance match to the cable 10 and to a mating connector, the conductive insert 41 is constructed with internal dimensions which satisfy the following formula (which is well known in the art):

$$Zo = \frac{138 \log(D/d)}{e_r^{\frac{1}{2}}}.$$

where $Z_0$ = the desired impedance of the coaxial connector;

D = the internal diameter of the conductive insert 41 at the small end;

d = the diameter of the inner conductor 12; and $e_r$ = the relative permittivity of the dielectric sleeve 42.

As can be seen from the foregoing detailed description of the illustrative embodiments of the invention, the improved connector assembly provides identical electrical and mechanical characteristics as existing coaxial connectors, while using major components fabricated from lightweight, nonmetallic materials. Moreover, the improved connector can be efficiently and economically manufactured using a relatively small number of parts.

We claim:

1. A connector assembly for a coaxial cable having a corrugated outer conductor and an inner conductor, said connector assembly comprising:

a flaring ring and a clamping member for engaging opposite sides of an outwardly flared end portion of the outer conductor of the coaxial cable, said flaring ring being made of an electrically conductive material, said clamping member having a threaded inner surface for threadingly engaging the corrugated outer conductor, and said clamping member being made of a polymeric material;

a body member having means for holding said flaring ring and said clamping member together, against opposite sides of the flared end portion of the outer conductor of the cable, said body member being made of a polymeric material; and an electrically conductive insert secured within said body member, in electrical contact with said flaring ring.

2. The connector assembly of claim 1 which includes a coupling member, secured to said body member, for coupling the connector assembly to a mating member, said coupling member being made of a polymeric material.

3. The connector assembly of claim 1 wherein a portion of said conductive insert is captured between said body member and said flaring ring so that said body member holds said conductive insert in contact with said flaring ring, and said flaring ring is held in contact with the flared end portion of the outer conductor.

4. The connector assembly of claim 1 wherein the characteristic impedance of the connector assembly is Zo, and the end of said conductive insert that contacts said flaring ring has an internal diameter (D), a center conductor has an outer diameter (d), and said dielectric insulator has a relative permittivity ($e_r$), such that $$Zo = \frac{138 \log(D/d)}{e_r^{\frac{1}{2}}}.$$

5. A connector assembly for a coaxial cable having a corrugated outer conductor and an inner conductor, said connector assembly comprising:

a center conductor adapted to engage the inner conductor of the coaxial cable;

a metal flaring ring and a polymeric clamping member having opposed surfaces for engaging respective inner and outer surfaces of the outer conductor of the coaxial cable, said clamping member having a threaded inner surface for threadingly engaging the corrugated outer conductor;

a polymeric body member having means for drawing and holding the opposed surfaces of said flaring ring and said clamping member together against the respective inner and outer surfaces of the outer conductor of the cable;

a polymeric coupling member, secured to said body member, for coupling the connector assembly to a mating member; and a metal insert secured within said body member in electrical contact with said flaring ring.

6. The connector assembly of claim 1, wherein said clamping member is unitary.

7. The connector assembly of claim 6, wherein said clamping member includes a threaded outer surface and said body member includes a threaded inner surface engaging with said threaded outer surface of said clamping member to form said holding means.

* * * * *